United States Patent [19]

Thompson

[11] 4,199,394

[45] Apr. 22, 1980

[54] RIBBED FIBER PANEL AND MEANS AND METHOD OF MANUFACTURE

[76] Inventor: James D. Thompson, P.O. Box 684, Sturges, Mich. 49091

[21] Appl. No.: 930,666

[22] Filed: Aug. 3, 1978

Related U.S. Application Data

[62] Division of Ser. No. 866,839, Jan. 4, 1978.

[51] Int. Cl.[2] ..... B31F 1/34

[52] U.S. Cl. ..... 156/461; 156/201; 156/474

[58] Field of Search ..... 156/200–202, 156/443, 461–463, 474, 204; 93/84 R; 264/286; 425/336, 396, 369, 374; 428/181

[56] References Cited

U.S. PATENT DOCUMENTS

| | | | |
|---|---|---|---|
| 1,944,280 | 1/1934 | Snyder | 428/181 X |
| 1,996,490 | 4/1935 | Romanoff | 428/181 X |
| 2,196,006 | 4/1940 | Benedict | 156/201 |
| 2,658,551 | 11/1953 | Bender | 156/474 X |
| 2,793,676 | 5/1957 | Hubmeier | 156/462 |
| 3,931,383 | 1/1976 | Erlewine et al. | 264/286 X |

*Primary Examiner*—David A. Simmons
*Attorney, Agent, or Firm*—Bacon & Thomas

[57] ABSTRACT

A high strength ribbed panel assembly formed of laminated plastic impregnated fibrous sheet stock to form a flat panel member; the panel member including a surface lamination which is provided with sets of multiple laminations integral with the surface lamination and extending laterally therefrom to form a series of spaced reinforcing ribs; a pair of the panel assemblies may be so proportioned as to be joined with their ribs in overlapping, mutually bonded relation to form a pallet suitable for shipping and storage.

The method of manufacturing involves the steps of forming the ribs by progressively folding selected portions of a plastic impregnated fibrous sheet into mutual contact to form a plurality of multi-laminated ribs, applying additional laminations over the plastic sheet to form a panel assembly, then joining a pair of assemblies with their respective ribs bonded together. The means of manufacture involves means for carrying out the method.

4 Claims, 11 Drawing Figures

RIBBED FIBER PANEL AND MEANS AND METHOD OF MANUFACTURE

This is a division of application Ser. No. 866,839, filed Jan. 4, 1978.

BACKGROUND

High strength panels have been formed of plastic impregnated laminations of fabric sheet material, such material has been formed into tubular structures, and have been applied against a form to produce, for example a boat hull. However, to form panels with reinforcing ribs projecting therefrom, such as required for use as pallets, has posed problems of obtaining suitable strength at the juncture between the panel and ribs, as well as the cost of manufacture.

SUMMARY

The present invention is directed to a ribbed fabric panel and to its means and method of manufacture, which overcomes the problems previously encountered, and is summarized in the following objects:

First, to provide a ribbed fabric panel assembly formed of laminated, plastic impregnated, fibrous sheet stock to form a flat panel member, the panel member having on one surface a lamination which is provided with sets of integral multiple folded laminations projecting therefrom in spaced relation to form a series of spaced reinforcing ribs.

Second, to provide a ribbed fabric panel, as indicated in the preceding objects, wherein a pair of such panels are so arranged as to be assembled with their ribs disposed side by side in bonded relation to form a shipping and storage pallet.

Third, to form a plastic impregnated fabric panel, as indicated in the preceding object, wherein selected pairs of ribs are provided with co-registered openings to receive high strength shear plugs formed of impregnated fabric.

Fourth, to provide a means and method of manufacturing ribbed fiber panels in which a fabric sheet is drawn across a table while a central portion, of preselected width, is folded perpendicularly to the table to form multiple laminated longitudinally extending lateral ribs, the ribs being connected by the remaining fabric sheet, then applying other laminations of fabric sheets over the remaining plastic sheet; the fabric sheets being plastic impregnated for treatment to bond the multiple laminations of the fabric sheets and the multiple laminations forming the ribs.

Fifth, to provide a ribbed fiber panel and means and method of manufacture wherein the fibers are utilized to their greatest extent, thereby producing a structure of high strength and minimum weight having excellent thermal, ablative, environmental, compression properties, all providing long use expectancy, whereby the amortized cost is minimal.

DETAILED DESCRIPTION

Figure 1:
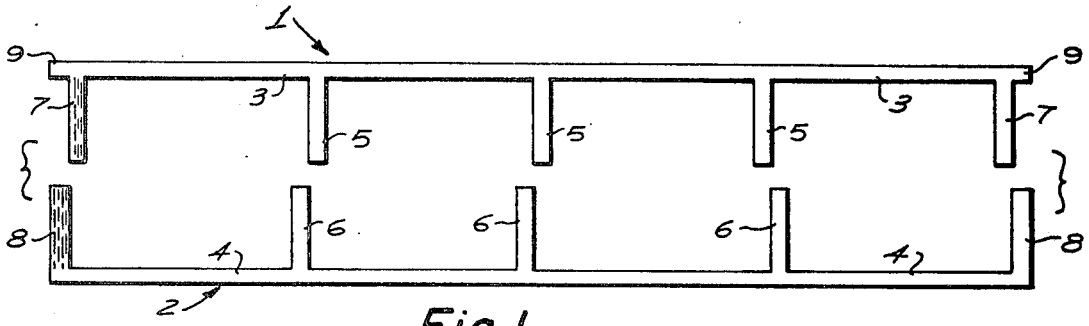
FIG. 1 is an end view of the ribbed fiber panel with its two components separated.
Figure 2:
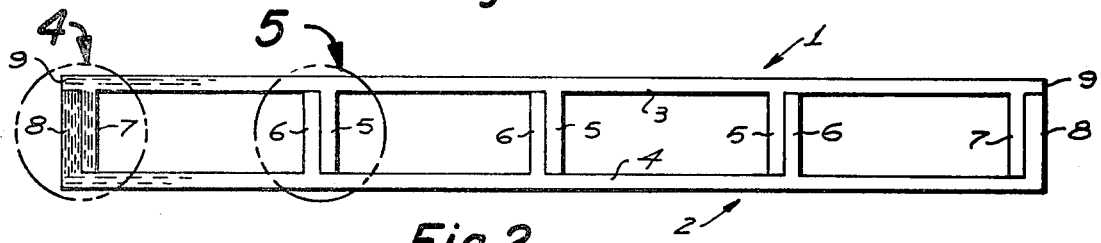
FIG. 2 is an end view thereof showing the two components joined.
Figure 3:
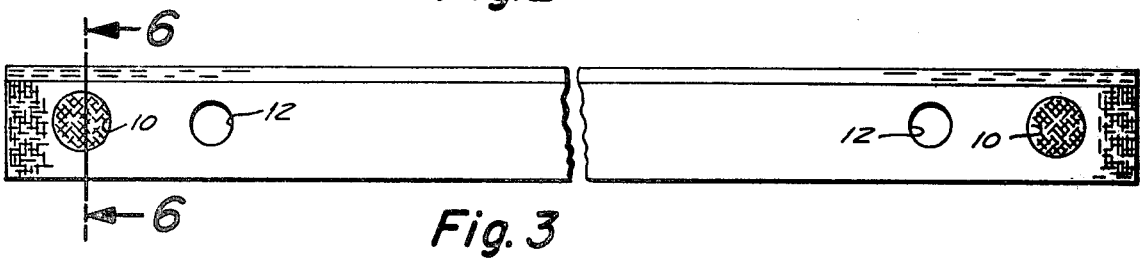
FIG. 3 is a fragmentary side view thereof.

Referring to FIGS. 1, 2, and 3, for purposes of illustration but not limitation, the ribbed fiber panel is shown as arranged to form a pallet having components 1 and 2, the components including plate structures 3 and 4 having intermediate ribs 5 and 6 disposed in parallel relation and parallel side ribs 7 and 8.

The two pallet components 1 and 2 are adapted to be positioned with their respective ribs in contiguous overlapping relation as shown in FIG. 2. The side ribs 8 preferably have greater thickness than the side ribs 7 and are positioned outwardly thereof. The pallet component 1 is provided with marginal flanges 9 which overlie the side ribs 8.

The contiguous side ribs 7 and 8 are provided near each end with aligned transverse bores 10 which receive shear plugs 11. Other openings 12 may be provided at selected locations in the ribs for purposes of tying down the pallet.

Figure 4:
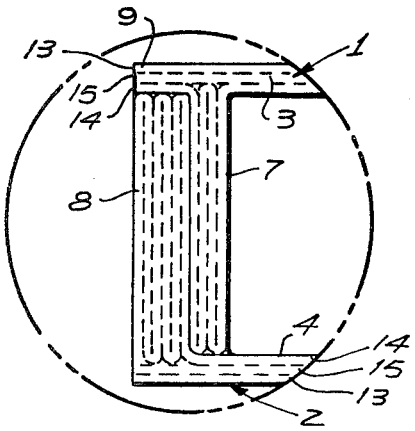
FIG. 4 is an enlarged sectional view thereof taken within circle 4 of FIG. 2.
Figure 5:
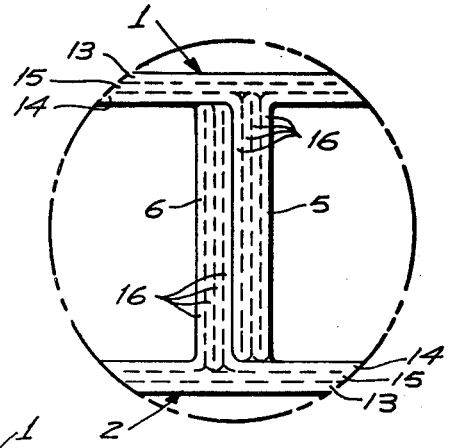
FIG. 5 is an enlarged fragmentary view thereof taken within circle 5 of FIG. 2.
Figure 6:
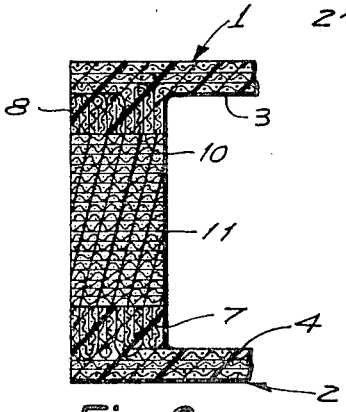
FIG. 6 is an enlarged fragmentary sectional view taken through 6—6 of FIG. 3.
Figure 7:
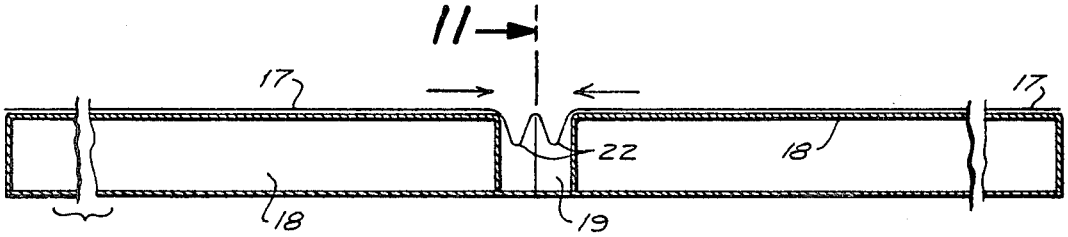
FIGS. 7, 8, 9 and 10 are diagrammatical transverse sectional views of the means for manufacturing the ribbed fiber panel taken respectively through 7—7, 8—8, 9—9 and 10—10 of FIG. 11.
Figure 8:
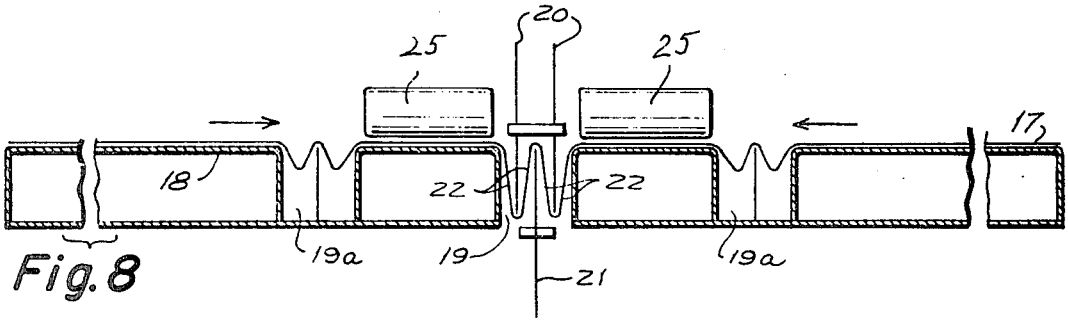
Figure 9:
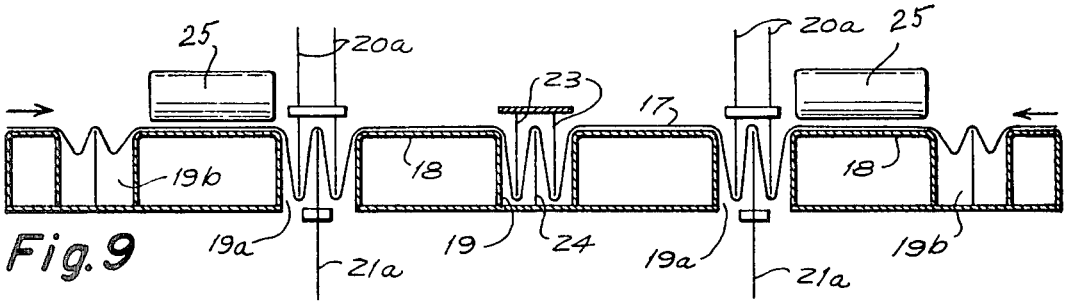
Figure 10:
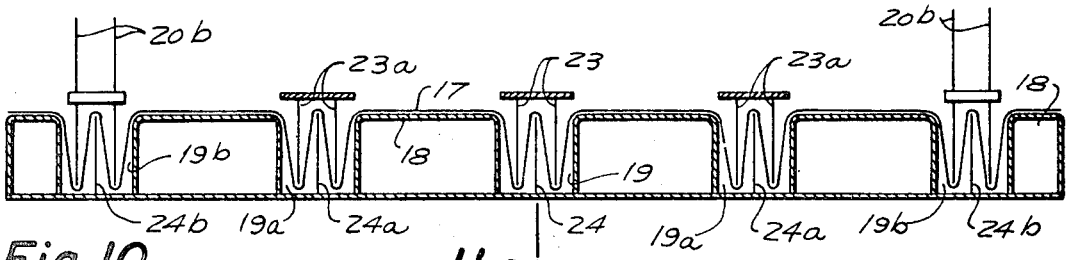
Figure 11:
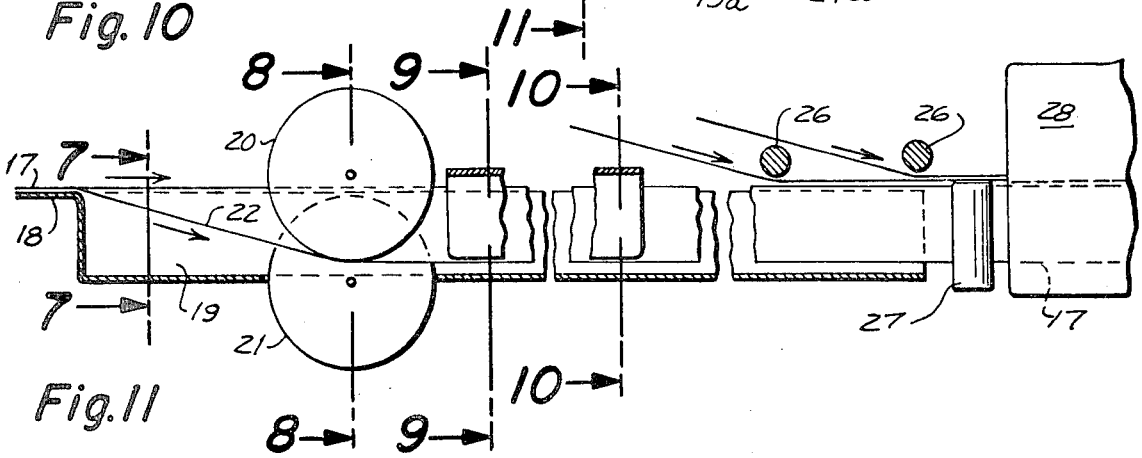
FIG. 11 is a diagrammatical fragmentary longitudinal sectional view taken in the plane 11—11 common to FIGS. 7, 8, 9 and 10.

Referring to FIGS. 4, 5 and 6 the pallet components 1 and 2 are formed from sheet fabric material impreganted with plastic material. The plate structure of each component comprises of outer lamination 13, an inner lamination 14, and one or more intermediate laminations 15. Appropriate longitudinally extending portions of the inner lamination 14 are folded to form a plurality of laminations 16 constituting the ribs 5, 6, 7 and 8.

The laminations are in the form of woven sheets or mats which may be formed of a wide variety of materials such as hemp, jute, sisal, ramie, burlap, cotton or fiber glass or combinations thereof. It is preferred that the material be relatively rough and have random projecting fibers.

Prior to being formed, the fiber mat is impregnated with an appropriate plastic material which is sufficiently flexible before being cured to permit the inner lamination 14 to be folded in order to form the ribs 16, curing and bonding of the laminations may be thermal or catalytic. Appropriate plastic materials are well known and have been used to impregnate fibrous material.

The ribs 5, 6, 7 and 8 are formed by the means and method shown diagrammatically in FIGS. 7 through 11. A mat 17 is drawn across a table 18 having a central clearance channel 19. Extending into the channel is a pair of rotatable top folding disks 20 and a central bottom folding disk 21. For purposes of illustration the lateral spacing of the disks is exaggerated. As the mat 17 moves past the disks the mat is drawn laterally towards the center and folds progressively as indicated by 22, once folded the folded condition is maintained by top retainer blades 23 and bottom retainer blade 24. The folding disks 20 and 21 and the blades 23 and 24 are coated to minimize friction, this may be done by use of such materials known under the trademark TEFLON.

After the central portion of the mat has been folded to form the central rib, the ribs on either side thereof may be formed in a pair of lateral clearance channels 19*a* which receives rotatable top folding disks 20*a*, rotatable bottom folding disks 21*a*, as well as top retainer blades 23*a* and bottom retainer blades 24*a* to form progressive folds 22*a*.

This procedure may be repeated a second time to form a total of five ribs by using clearance channels 19*b*, rotatable top folding disks 20*b*, top retainer blades, not shown, and bottom retainer blades 24*b*; it will be noted that the bottom retainer blade 24*b* is used in place of rotatable bottom folding disks merely to indicate that, if the friction in the drawing of the mat into a folded condition permits, the bottom folding may be omitted. It will be noted that as the area of the mat being moved is reduced in width the force required to effect a folding operation is also reduced.

In order to prevent retraction movement of the mat, the portions of the mat laterally of a formed rib may be engaged by restraining rollers 25.

After the folding process which produces the ribs has been completed, the intermediate lamination 15 and outer lamination 13 may be passed under guide rollers 26 and onto the upper surface of the inner lamination 14 formed by the mat 17. Also side rollers 27 may compress the ribs laterally after the ribs have passed the blades 23*b* and 24*b*, after the laminations 15 and 13 have been applied the pallet component thus formed may be passed into an oven 28 while being suitably supported while being cured. If a catalytic resin is used an oven may not be needed however, the presence of heat will accelerate the catalytic reaction.

The pallet component illustrated as being formed in FIGS. 7 through 11, is a pallet component 1; slight modification is required in order to form pallet component 2, such as the addition of a third top folding blade 20*b* and a corresponding set of retainer blades.

It should be noted that if it is desired to form both pallet components simultaneously the apparatus for forming one of the components may be inverted so that the completed components may be pressed together completing the pallet.

It should be noted that while for purposes of illustration, the ribbed fiber panel forms a component of a pallet, other ribbed structures may be formed, for example the panel may form a wall structure and in fact a pair of panels may form a complete wall structure as distinguished from a pallet.

It should be further noted that the strands of alternate laminations may be placed at, for example, forty five degrees to the strands of other laminations. Other angular relations of the strands may be selected to provide a multi-directional pattern.

Having fully described my invention it is to be understood that I am not to be limited to the details herein set forth, but that my invention is of the full scope of the appended claims.

I claim:

1. Means for forming a ribbed panel, characterized by:

a. a table for supporting longitudinally movable flexible sheet of fibrous material impregnated with a bonding plastic in a plastic state;

b. means forming a set of rib receiving slots extending longitudinally of the table;

c. means for forcing parallel portions of the sheet material in succession into the slots to form pairs of longitudinally extending rib forming laminations in the material, joined by webs of the material;

d. means for restraining the laminations in their formed condition;

e. means for pressing the laminations together for bonding engagement to form the ribs;

f. and means for causing the plastic to stiffen the ribs and connecting webs of the material.

2. A ribbed panel forming means as defined in claim 1, wherein:

a. the initial rib receiving slot and rib forming means occupies the central portion of the sheet material, and the remaining slots and rib forming means are disposed in laterally and longitudinally offset relation with the initial slot and rib forming means.

3. A ribbed panel forming means as defined in claim 1, wherein:

a. each rib forming means includes a plurality of rotatable disks movable into corresponding rib receiving slots, to form at least two pair of rib forming laminations in each slot.

4. A ribbed panel forming means as defined in claim 3, wherein:

a. the restraining means are fixed blades extending longitudinally in the slots.

* * * * *